United States Patent [19]

Lin

[11] Patent Number: 4,997,712

[45] Date of Patent: Mar. 5, 1991

[54] CONDUCTIVE FILAMENTS CONTAINING POLYSTYRENE AND ANTI-STATIC YARNS AND CARPETS MADE THEREWITH

[75] Inventor: Perry H. Lin, Seaford, Del.

[73] Assignee: E. I. du Pont de Nemours and Company, Wilmington, Del.

[21] Appl. No.: 406,575

[22] Filed: Oct. 5, 1989

Related U.S. Application Data

[62] Division of Ser. No. 179,015, Apr. 8, 1988, Pat. No. 4,900,495.

[51] Int. Cl.[5] ..... D02G 3/00

[52] U.S. Cl. ..... 428/372; 428/368; 428/373; 428/374; 428/369

[58] Field of Search ..... 428/364, 372, 373, 374, 428/368

[56] References Cited

U.S. PATENT DOCUMENTS

| | | | |
|---|---|---|---|
| 3,382,305 | 5/1968 | Breen | 264/171 |
| 3,803,453 | 4/1974 | Hull | 317/2 R |
| 3,969,559 | 7/1976 | Boe | 428/87 |
| 3,971,202 | 7/1976 | Windley | 57/140 BY |
| 4,085,182 | 4/1978 | Kato | 264/171 |
| 4,216,264 | 8/1980 | Naruse et al. | 428/370 |
| 4,309,479 | 1/1982 | Naruse et al. | 428/408 |
| 4,420,534 | 12/1983 | Matsui et al. | 428/372 |
| 4,518,744 | 5/1985 | Brody | 525/184 |
| 4,612,150 | 9/1986 | DeHowitt | 264/103 |
| 4,664,971 | 5/1987 | Soens | 428/372 |
| 4,743,505 | 5/1988 | Yamada et al. | 428/378 X |

FOREIGN PATENT DOCUMENTS

| | | | |
|---|---|---|---|
| 0047464 | 3/1982 | European Pat. Off. . | |
| 49412 | 4/1982 | European Pat. Off. . | |
| 53-25893 | 3/1978 | Japan . | |
| 53-025893 | 3/1978 | Japan | 264/105 |
| 9101381 | 7/1981 | Japan . | |

*Primary Examiner*—Lorraine T. Kendell

[57] ABSTRACT

A process wherein freshly-spun, undrawn, nonconductive filaments are combined with one or more spin-oriented, conductive filaments having a nonconductive component made from a major portion of nonconductive, fiber-forming polymeric material and a minor amount of polystyrene, the combined fibers being drawn and co-bulked to produce an anti-static yarn. The conductive filaments used in this process have higher elongations to break, and carpets tufted from the yarns of the process show improved anti-static properties.

8 Claims, 2 Drawing Sheets

CONDUCTIVE FILAMENTS CONTAINING POLYSTYRENE AND ANTI-STATIC YARNS AND CARPETS MADE THEREWITH

This is a division of application Ser. No. 07/179,015, filed Apr. 8, 1988, now U.S. Pat. No. 4,900,495.

BACKGROUND OF THE INVENTION

Windley U.S. Pat. No. 3,971,202 describes cobulking electrically conductive sheath-core filaments such as those disclosed in Hull U.S. Pat. No. 3,803,453 with nonconductive filaments to form a crimped, bulky carpet yarn which dissipates static electricity charges which are annoying to people who walk on nonconductive carpets when humidity is low.

De Howitt U.S. Pat. No. 4,612,150 describes introducing spin-oriented electrically conductive bicomponent filaments into a quench chimney wherein nonconductive filaments are melt spun and cooled, combining the conductive and nonconductive filaments at a puller roll, drawing and cobulking the combined yarn and then winding up the yarn. While the above process is an improvement over previous methods of producing antistatic yarns for carpets and other uses, the spinning and winding speed of the conductive bicomponent filaments is often limited to about 1400 yards per minute (ypm) (1281 meters per min.) so that the filaments will not break when they are drawn at the same draw ratio as is required for the nonconductive filaments. Higher spinning speeds produce higher orientation in the conductive filaments which reduces their elongation to break. With lower elongation, occasional filament breaks occur which cause filament wraps in the processing equipment and gaps in the conductive filaments in some portions of the product, thus resulting in reduced productivity, poor static dissipation, and defective or lower quality product.

Brody U.S. Pat. No. 4,518,744 discloses a process of melt spinning a fiber-forming thermoplastic polymer, more particularly polyethylene terephthalate, polyhexamethylene adipamide or polypropylene, at a minimum wind-up speed of 2 kilometers per minute in which there is added to the fiber-forming polymer between 0.1% and 10% by weight of another polymer which is immiscible in a melt of the fiber-forming polymer, such other polymer having a particle size of between 0.5 and 3 microns in the melt of the fiber-forming polymer immediately prior to spinning. Brody also discloses melt spun fibers produced by such a process and in which the other polymer is in the form of microfibrils.

SUMMARY OF THE INVENTION

It has now been found that the elongation to break of conductive, spin-oriented, polymeric filaments, such as those made from polyhexamethylene adipamide or polypropylene, may be increased by blending a small quantity of polystyrene with the nonconductive polymeric component of bi- or multi-component conductive filaments known to the art. The polystyrene should have a melt flow index less than 25, preferably less than 10.

A preferred species of the invention is a bicomponent filament wherein one fiber-forming component is nylon 6,6 or polypropylene melt-blended with between 0.1 and 10 percent by weight polystyrene with a second component of electrically conductive carbon dispersed in a polymeric matrix such as polyethylene. In the composite filament, the component of nylon or polypropylene blended with polystyrene is coextensive with the conductive component, but may be aligned with the conductive component either concentrically, eccentrically, or side-by-side.

A further embodiment of the invention is a combined yarn comprising nonconductive polymeric filaments and at least one conductive composite filament described above. Such yarns may be crimped and tufted to form carpets with good antistatic properties.

An additional embodiment of the invention is a process for combining nonconductive polymeric filaments, preferably nylon, polypropylene, or polyester, with the conductive bicomponent or multicomponent filaments described above by introducing the composite filaments into a quench chimney wherein nonconductive filaments are melt spun and cooled, combining the conductive and nonconductive filaments at a puller roll, drawing and cobulking the combined yarn and then winding up the yarn.

DETAILED DESCRIPTION OF THE DRAWINGS

Conductive filaments used in this invention are prepared by high speed spinning of bicomponent or multicomponent filaments as described below. Preferred filaments are sheath/core, i.e., where the nonconductive component fully encapsulates a conductive core as disclosed in Hull U.S. Pat. No. 3,803,453, the specification of which is incorporated herein by reference. Filaments as described by Boe U.S. Pat. No. 3,969,559 and Matsui et al. U.S. Pat. No. 4,420,534 are also included. Those filaments wherein the nonconducting component (or constituent) encapsulates or surrounds more than 50% but less than all of the conducting component are less preferred, however, because of limitations on the types of conductive material that may be employed and because aesthetics may be adversely affected.

The sheath component polymers that may be used for the conductive filaments of the present invention are fiber-forming nylon, polypropylene, or polyester to which is added minor amounts of polystyrene preferably by melt blending prior to spinning. Salt blending, i.e., admixing polystyrene with, for example, nylon salt before it is polymerized, may also be used. Titanium dioxide, while not necessary for this invention, is added conventionally to the sheath as a delusterant and to improve hiding of the core. Substantially greater amounts of $TiO_2$ than disclosed in Hull may be added to the sheath polymer, if desired. The preferred sheath polymer is a 6,6 nylon polyamide e.g. polyhexamethylene adipamide, but 6-nylon, e.g. polyepsilon-caproamide can also be used. The preferred polyester is polyethylene terephthlate.

The core component materials that may be used are the same as those disclosed by Hull and may be prepared similarly. The preferred core polymer matrix material is a polyolefin, most preferably, polyethylene. The core polymer should contain between 15 and 50% by weight of electrically conductive carbon black dispersed therein. Preferably, the core will constitute less than 10% by volume of the conductive filament.

The materials useful for preparing bicomponent conductive filaments wherein the nonconductive component encapsulates more than 50% of the conductive component are taught in Boe, supra, and are similar to those of Hull. The Bo and Matsui patents also describe processes for making the filaments.

Figure 1:
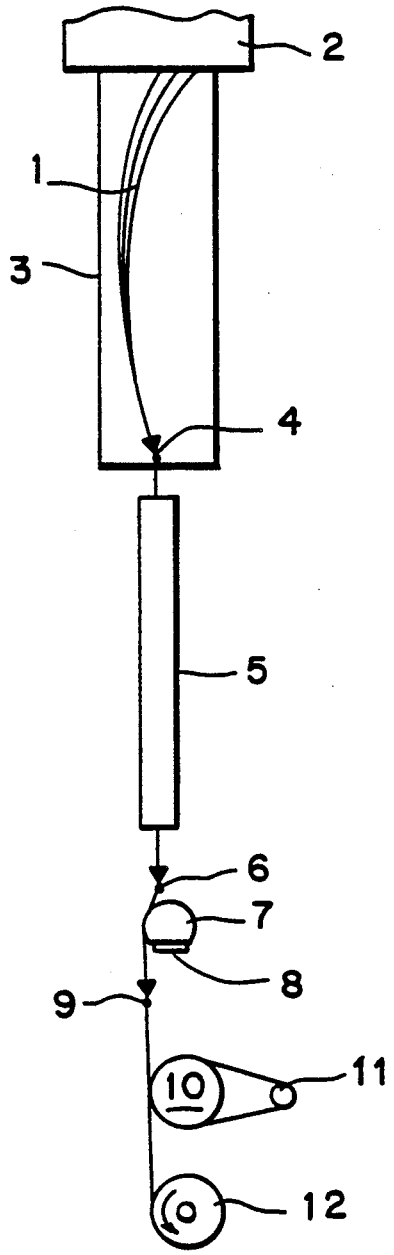
FIG. 1 is a schematic of a preferred process for making a conductive yarn of this invention.

Spinning of the conductive filaments useful in this invention is accomplished as shown in FIG. 1. The component materials of filaments 1 are extruded from a spinneret assembly 2 into quench chimney 3 and are cross-flow quenched by room-temperature air flowing from right to left. After cooling to a non-tacky state, the filaments are converged into a yarn by guide 4 and pass through steam conditioner tube 5 through guide 6, over finish roller 7 immersed in finish bath 8 through guide 9, then wrapped around high-speed puller roll 10 and associated roller 11, and are wound up as package 12 in a manner similar to Hull, except that the filaments are attenuated by pulling the filaments away from the quenching zone (as shown in Adams U.S. Pat. No. 3,994,121) at a speed of at least 800 ypm (732 mpm), preferably between 1250 and 1500 ypm (1143 and 1372 mpm). The spinning speed is the speed at which the yarn leaves the quenching zone and is equivalent to the peripheral speed of the puller rolls. The spinning speed is adjusted to produce filaments having a preferred denier from about 6 to 11.

The resulting filaments are characterized by having a tenacity of from about 1 to 3 gpd and an elongation of between 200 and 500%. As for those bicomponent filaments in which the nonconducting component only partially encapsulates the conductive component, a similar extrusion process to that in Boe may be employed and the filaments attenuated by pulling from the quenching zone at the appropriate speed.

A feature of the present invention it that it provides a carpet yarn with reduced static propensity.

In the products of the invention, the yarn is ordinarily made up of conductive filaments in an amount of less than about 10 weight percent, preferably from 1 to 10 weight percent, with the remainder being nonconductive filaments.

It is desirable that the conductive filaments be as thin as possible, i.e., of the aforementioned low denier range of 6 to 11 dpf. The conductive filaments containing a component of carbon black, dispersed in a polymer matrix to provide electrical conductivity, generally tend to have a dark appearance, and thin dark filaments are less conspicuous to the eye. Such thin filaments also provide an economic advantage since the level of antistatic performance is not comparably reduced, with denier reduction, i.e., the thinner filaments retain most of the antistatic capabilities of the thicker filaments, in spite of the fact that less conductive material is used.

The use of polystyrene, which is immiscible in any of the fiber-forming polymers commonly used in the nonconductive component of the filament, results in elongated polystyrene striations distributed throughout the nonconductive component.

Conductive filaments of the invention made with minor amounts of polystyrene surprisingly have elongations to break about 25% or more higher than filaments not containing polystyrene. Furthermore, the lower orientation and higher elongation of the nonconductive component increases the conductivity of the conductive component so that a certain quantity of conductive filaments of the present invention in the carpet yarn gives a much lower carpet static level than carpets made with conductive filaments described in the De Howitt patent.

DESCRIPTION OF THE TEST PROCEDURES

Unless otherwise indicated, all measurements, test procedures and terms referred to herein are as defined and described in the aforementioned Windley, Hull and Adams patents. Melt flow index of polystyrene is determined using ASTM-D-1238, condition G.

In the following Examples, parts and percentages are by weight, unless otherwise indicated.

EXAMPLE 1

Sheath Composition

Polyhexamethylene adipamide containing 0.3% rutile $TiO_2$ and Mn $(H_2PO_2)_2$(9 ppm Mn based on polymer), is prepared with agitation in an autoclave to insure good $TiO_2$ dispersion in polymer. The polymer has a relative viscosity (RV) of 40. To this is added five percent polystyrene (Mobil PS 1800; molecular weight 280,000; melt flow index 1.5) by flake blending in a blender.

Core Composition

A polyethylene resin (Alathon 4318, density 0.916, melt flow index 23 as measured by ASTM-D-1238, 50 ppm antioxidant, manufactured by Du Pont) is combined with electrically conductive carbon black in the ratio 67.75 weight percent resin to 32.0 percent carbon black with 0.25% Antioxidant 330 (Ethyl Corporation 1,3,5 trimethyl 2,4,6-tris(3,5-ditertiarybutyl-4-hydroxybenzyl)benzene.) The carbon black is Vulcan P available from the Cabot Corporation, Boston, Mass. The carbon black dispersion is compounded in a Banbury mixer, extruded, filtered and pelletized. The pellets are remelted, extruded and filtered through filter media retaining 31 micron particulates, and pelletized. Specific resistance, measured as described by Hull U.S. Pat. No. 3,803,453, is less than 10 ohm-cm.

Spinning of the Conductive Yarn

The polymers are spun using a spinneret assembly to spin concentric sheath core filaments by the technique shown in U.S. Pat. Nos. 2,936,482 and 2,989,798.

The sheath polymer is melted at 288° C. at atmospheric pressure and is fed to a pack filter at a rate of 37.0 gm/min.

The core polymer containing 1% moisture is melted in a screw melter. Molten polymer is fed through a filter pack at a rate of 0.8 gm/min.

The spinning block temperature is 288° C. The core polymer supply hopper is purged with dry inert gas.

The RV of sheath polymer coming from the spinneret is about 47, the increased RV resulting from further polymerization of nylon while being melted.

Antistatic filaments are obtained by extruding the molten polymer materials from a spinneret with 30 capillaries. The extruded filaments pass through a 45 inch long chamber where they are cross-flow quenched with room temperature air. They then contact guides which converge them into yarns each containing three filaments. To improve yarn windup, the yarns are passed into a 78 inch long steam conditioning tube (see Adams U.S. Pat. No. 3,994,121, Ex. 1) into which 1.8 psig steam is introduced from two 0.04 in orifices near the top of the tube and one 0.050 in orifice near the center of the tube. A mineral oil-based finish (about 2%) is then applied to the yarn to aid in packaging. The yarn is spun at a feed roll speed of 1325 ypm (1212 mpm) and the yarn is packaged at under a tension of 5.0 gms per threadline.

The three-filament yarns which have been oriented by spinning, hence "spin-oriented", are characterized by having a tenacity of 1.8 gm/den and an elongation of 310%. Denier is 28. Percent core is 2% by volume. Percent sheath is 98% by volume.

As a control, sheath-core yarns without polystyrene are prepared and spun under similar conditions. The elongation of the control yarns is 250%.

Preparation of Carpet Yarn

Figure 2:
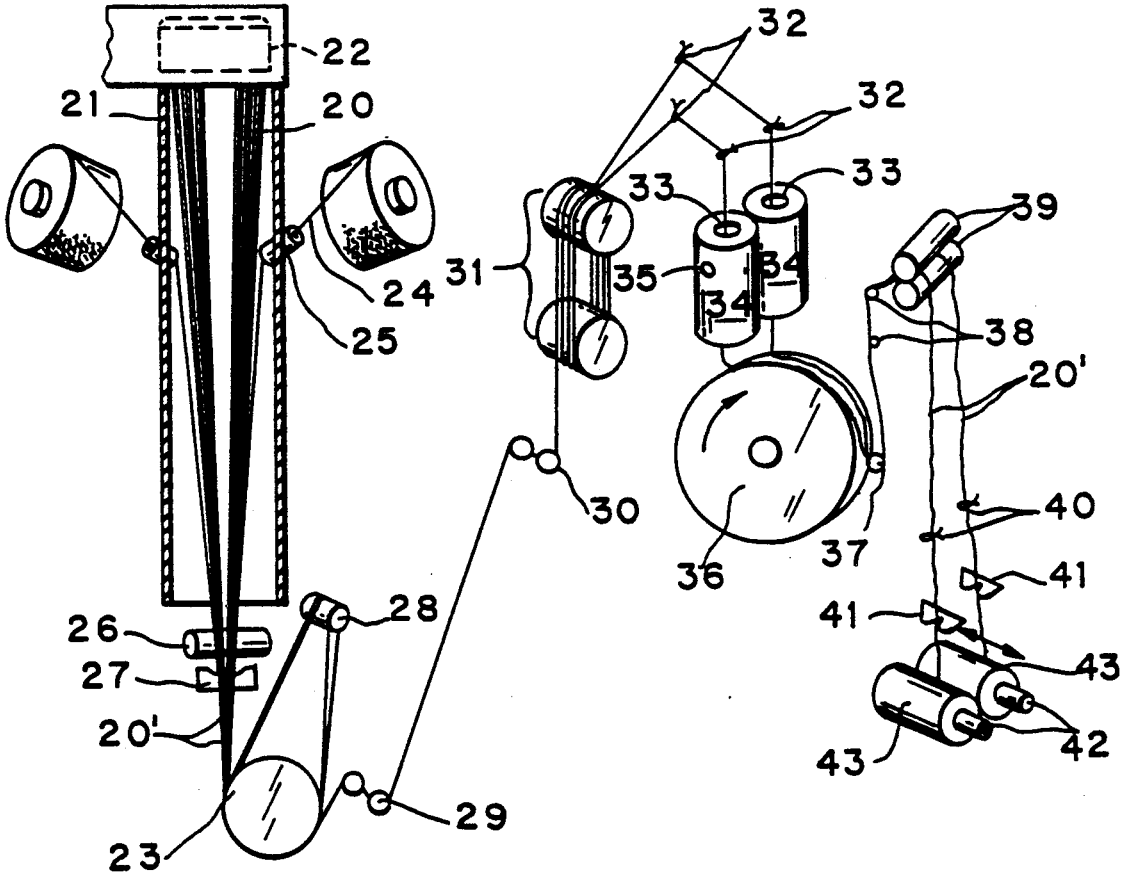
FIG. 2 is a schematic of a process of the invention where one or more spin-oriented conductive bicomponent or multicomponent filaments are combined with a freshly spun, undrawn nonconductive yarn in the quench chimney before reaching the puller or feed roll and the combined yarn is forwarded to draw rolls, then cobulked and delivered to packaging.

The preparation of the carpet yarn will be best understood with reference to FIG. 2. Several ends of the conductive yarn described above are combined with an undrawn nonconductive yarn threadline at a location prior to the puller roll and the combined yarn is then drawn, annealed and bulked as follows:

FIG. 2 shows production of two ends of carpet yarn. In this figure, polyhexamethylene adipamide (72 RV) for the nonconductive yarns (80 filaments per end) is melt spun at 295°-300° C. into a quench chimney 21 where a cooling gas is blown past the hot filaments 20 at 370 standard cubic feet/min. (10.5 $m^3$/m). The filaments are pulled from the spinneret 22 and through the quench zone by means of a puller or feed roll 23 rotating at 860 ypm (786 mpm). The conductive yarns 24 described above fed from packages are directed by a gaseous stream via forwarding jet 25 fed with air at 30 psig (206.9 kPa gauge) into the nonconductive threadlines approximately 2 feet (0.61 m) below the spinneret and become part of the threadlines as they travel to the feed roll. After the conductive yarn reaches feed roll 23 air to the forwarding jet is discontinued. After quenching, the integral threadlines 20, are each converged and treated with finish by contacting finish roller 26 which is partially immersed in a finish trough (not shown). Proper contact with the finish rollers is maintained by adjustment of "U" guides 27. Next, the threadlines pass around the feed roll 23 and its associated separator roll 28, around draw pin assembly 29, 30 to draw rolls 31 (internally heated to produce a surface temperature of 208° C.) rotating at 2580 ypm (2359 mpm) which are enclosed in a hot chest (not shown), where they are forwarded by the rolls 31 at a constant speed through yarn guides 32 and through the yarn passageways 33 of the jet bulking devices 34. In the jets 34, the threadlines 20, are subjected to the bulking action of a hot air (220° C.) directed through inlets 35 (only one shown). The hot fluid exhausts with the threadlines against a rotating drum 36 having a perforated surface on which the yarns cool to set the crimp. From the drum, the threadlines in bulky form pass to a guide 37 and in a path over a pair of guides 38 then to a pair of driven take-up rolls 39. Bulky yarns of this type are disclosed in U.S. Pat. No. 3,186,155 to Breen and Lauterbach. The threadlines 20, are then directed through fixed guides 40 and traversing guides 41 onto rotating cores 42 to form packages 43. Each end of the carpet yarn is 1220 denier (1332 dtex) and contains 83 filaments.

The level of static protection (shuffle voltage measured by AATCC Test Method 134 - 1979 version) of carpets tufted from the above yarns is a desirably low 1.4 KV. Carpets similarly tufted from control yarns made without polystyrene show a shuffle voltage of 3.2 KV.

EXAMPLE 2

Examples 2A-2E relate to fibers which do not contain a conductive component, but demonstrate the effect of polystyrene on elongation of the nonconductive component of conductive filaments.

EXAMPLE 2A

This Example shows the impact of polystyrene concentration on fiber elongation and orientation. 2-10% by weight of Mobil PS 1400 polystyrene (melt flow index 2.5, molecular weight 200,000) is flake blended with a 41 RV polyhexamethylene adipamide. Polymer blends are melted in a 28 mm single screw extruder and are fed to a pack filter at 32.0 grams/minute. Polymer temperature is about 280° C. Filaments are obtained by extruding the molten polymer materials from a spinneret with 17 round cross-section capillaries. The extruded filaments pass through a 60 inch long chamber where they are cross-flow quenched with room temperature air. To improve yarn windup, the yarns are passed into an 88 inches steam conditioning tube. A mineral oil-based finish (about 2%) is then applied to the yarn, and the yarn is spun at a feed roll speed of 1800 meters per minute (1969 ypm).

| % POLYSTYRENE | % ELONGATION | BIREFRINGENCE |
|---|---|---|
| 0 | 150 | 0.0291 |
| 2 | 158 | 0.0282 |
| 4 | 203 | 0.0252 |
| 7 | 219 | 0.0155 |
| 10 | 274 | 0.0122 |

EXAMPLE 2B

Example 2A was repeated using a higher molecular weight polystyrene: Mobil PS 1800 with an average molecular weight of 280,000 and a melt flow index of 1.5. Conditions were similar to Example 2A except that polymer throughput was 24.9 grams per minute and feed roll speed was 1400 mpm (1531 ypm). Elongation is increased with increasing polystyrene concentration as shown below:

| % PS 1800 | % ELONGATION |
|---|---|
| 0 | 178 |
| 1 | 215 |
| 2 | 238 |
| 5 | 252 |
| 8 | 271 |
| 10 | 265 |

EXAMPLE 2C

This Example shows the impact of polystyrene viscosity on elongation. 5% by weight of Mobil polystyrene samples with melt flow indices ranging from 1.5 to 22 are flake blended with nylon 6,6 and spun into fibers using conditions described in Example 2B. Elongation results (shown below) show higher molecular weight (lower melt flow index) polystyrene is more effective in improving fiber elongation.

| POLYSTYRENE | MFI | % ELONGATION |
|---|---|---|
| PS 1800 | 1.5 | 271 |
| MX 5400 | 2.5 | 240 |
| PS 2124 | 7.5 | 234 |
| PS 2524 | 12 | 234 |
| PS 2824 | 22 | 207 |

EXAMPLE 2D

This Example shows that productivity can be increased by adding minor quantities of polystyrene. 4% by wt of PS 1400 polystyrene is flake blended with nylon 6,6 and extruded at 280° C. using the process described in Example 2A. Filaments are wound at 1200–2000 mpm feed roll speed. Polymer throughputs are varied to yield constant denier. As shown below, spinning speeds and therefore the productivity of making yarns with about 170–200% elongation can be increased by up to 50% with the addition of 4% polystyrene.

| | % ELONGATION | |
|---|---|---|
| SPEED MPM | 0% PS | 4% PS 1400 |
| 1200 | 203 | |
| 1400 | 178 | 217 |
| 1600 | 168 | 212 |
| 1800 | 154 | 203 |
| 2000 | | 172 |

EXAMPLE 2E

1–2% by weight PS 1800 polystyrene is flake blended with Shell polypropylene having a melt flow index of 15. Polymer blends are spun at 260° C. using the process described in Example 2A. The feed roll speed is 1400 mpm. Elongation of polypropylene fiber is increased with addition of polystyrene as shown below:

| POLYMER BLEND | % ELONGATION |
|---|---|
| Polypropylene (no additive) | 309 |
| 1% PS 1800 | 407 |
| 2% PS 1800 | 449 |

EXAMPLE 3

This Example shows the effect of adding polystyrene to sheath core conductive filaments where the sheath is comprised of polyester.

Sheath composition: 5% by weight of Mobil PS 1800 polystyrene is flake blended with a 22 HRV (RV measured in hexafluoroisopropanol) polyethylene terephthalate polymer T-1934 made by Du Pont.

Core composition: as described in Example 1 above.

Spinning: the polymers are spun using a spinneret assembly to spin concentric sheath core filaments by the technique shown in U.S. Pat. Nos. 2,936,482 and 2,989,798. The sheath polymers are melted at 280° C. in an extruder and are fed to a pack filter at a rate of 30.7 grams/minute. The core polymer is melted in a screw melter and is fed through a filter pack at a rate of 1.3 grams/minute.

Antistatic filaments are obtained by extruding the molten polymer materials from a spinneret with 17 capillaries. The extruded filaments pass through a 60 inch long chamber where they are cross-flow quenched with room temperature air. A synthetic aliphatic ester-based finish (about 1.5%) is then applied to the yarn to facilitate packaging. The yarn is spun at a feed roll speed of 1280 mpm (1400 ypm). As a control, T-1934 polyester polymer without the polystyrene additive is used as a sheath polymer and is spun under similar conditions.

| Yarn | % Elongation |
|---|---|
| Control | 151 |
| 5% polystyrene | 187 |

Example 4

This Example shows the effect of adding polystyrene to sheath core conductive filaments where the sheath is comprised of polypropylene.

Spinning conditions similar to those described in Example 3 except that polypropylene is used as the sheath polymer and a mineral oil-based finish (about 2%) is applied.

Sheath polymers: Shell polypropylene melt flow index 15 with 0% and 2% Mobil PS 1800 polystyrene.

| Yarn | % Elongation |
|---|---|
| Control | 343 |
| 2% polystyrene | 497 |

I claim:

1. A spin-oriented, conductive filament having a nonconductive polymeric component coextensive with a component of electrically conductive carbon dispersed in a polymeric matrix wherein the nonconductive polymeric component of the spin-oriented, conductive filaments is a melt-blend containing a major amount of a nonconductive, fiber-forming polymeric material and a minor amount of polystyrene.

2. The filaments of claim 1 where the nonconductive polymeric component of the spin-oriented, conductive filaments is in the form of a continuous, nonconductive sheath surrounding a core of electrically conductive carbon dispersed in a polymeric matrix.

3. The filaments of either claim 1 or 2 where the minor amount of the polystyrene melt-blended with the nonconductive, fiber-forming polymeric material is less than 25 percent by weight of the continuous, nonconductive sheath of the spin-oriented conductive filaments.

4. The filaments of either claim 1 or 2 where the minor amount of the polystyrene melt-blended with the nonconductive, fiber-forming polymeric material is between 0.5 and 10 percent by weight of the continuous, nonconductive sheath of the spin-oriented conductive filaments.

5. The filaments of either claim 1 or 2 where the polymer used in major amount to form the continuous, nonconductive sheath of the conducive filaments is of the same polymeric class as the freshly spun, undrawn, nonconductive filaments.

6. The filaments of either claim 1 or 2 where the polymer used in major amount to form the continuous, nonconductive sheath of the conductive filaments is nylon 6,6.

7. The filaments of either claim 1 or 2 where the polymer used in major amount to form the continuous, nonconductive sheath of the conductive filaments is polypropylene.

8. The filaments of either claim 1 or 2 where the polymer used in major amount to form the continuous, nonconductive sheath of the conductive filaments is polyester.

* * * * *